US009650178B2

(12) United States Patent
Maglio, Jr.

(10) Patent No.: US 9,650,178 B2
(45) Date of Patent: May 16, 2017

(54) WATERMELON POUCH

(71) Applicant: The Fresh Group, Ltd., Glendale, WI (US)

(72) Inventor: Sam J. Maglio, Jr., Mequon, WI (US)

(73) Assignee: The Fresh Group, Ltd., Glendale, WI (US)

( * ) Notice: Subject to any disclaimer, the term of this patent is extended or adjusted under 35 U.S.C. 154(b) by 0 days.

(21) Appl. No.: 14/596,492

(22) Filed: Jan. 14, 2015

(65) Prior Publication Data

US 2015/0197388 A1 Jul. 16, 2015

Related U.S. Application Data

(60) Provisional application No. 61/928,178, filed on Jan. 16, 2014.

(51) Int. Cl.

| | |
|---|---|
| ***B65D 33/04*** | (2006.01) |
| ***B65D 33/00*** | (2006.01) |
| ***B65D 30/00*** | (2006.01) |
| ***B65D 33/08*** | (2006.01) |
| ***B65D 33/25*** | (2006.01) |
| ***B65D 85/34*** | (2006.01) |

(52) U.S. Cl.

CPC ..... *B65D 33/04* (2013.01); *B65D 31/005* (2013.01); *B65D 33/004* (2013.01); *B65D 33/08* (2013.01); *B65D 33/2508* (2013.01); *B65D 85/34* (2013.01)

(58) Field of Classification Search

CPC ..... B65D 5/045; B65D 7/00; B65D 81/24; B65D 85/34; B65D 31/005; B65D 33/08; B65D 33/04; B65D 33/2508; B65D 33/06; B65D 33/004; B65D 33/007

USPC ..... 53/435; 206/457; 383/120

See application file for complete search history.

(56) References Cited

U.S. PATENT DOCUMENTS

| | | | | | |
|---|---|---|---|---|---|
| 3,502,258 | A | | 3/1970 | Kugler et al. | |
| D235,934 | S | | 7/1975 | Chernoff et al. | |
| 3,935,993 | A | * | 2/1976 | Doyen | B65D 75/008 383/104 |
| 4,353,497 | A | * | 10/1982 | Bustin | B65D 75/008 383/104 |
| 4,769,126 | A | | 9/1988 | Roen et al. | |
| 4,783,178 | A | * | 11/1988 | Herder | B65D 31/10 383/120 |
| 4,810,844 | A | * | 3/1989 | Anderson | B65D 31/10 219/727 |
| 4,847,145 | A | | 7/1989 | Matsui | |
| 4,876,125 | A | | 10/1989 | Akao et al. | |
| 4,876,146 | A | | 10/1989 | Isaka et al. | |
| 4,879,078 | A | | 11/1989 | Antoon, Jr. | |
| 4,894,264 | A | | 1/1990 | Akao et al. | |

(Continued)

*Primary Examiner* — Peter Helvey

(74) *Attorney, Agent, or Firm* — Boyle Fredrickson, S.C.

(57) ABSTRACT

A watermelon pouch designed with a gusseted floor to accommodate a large watermelon slice. The pouch provides an upwardly concave interior volume to orient and stabilize a watermelon for best presentation and least damage, and sturdy sidewalls to support the pouch and contained watermelon on a flat surface. The pouch is re-closable by a zip-lock seal and includes a handle for easy carrying. The watermelon pouch includes a transparent window to allow the consumer to view the watermelon slice inside the pouch, and the transparent window is framed by a graphical element to enhance the product's visual appeal.

16 Claims, 7 Drawing Sheets

(56) References Cited

U.S. PATENT DOCUMENTS 4,895,729 A 1/1990 Powrie et al.
4,904,093 A * 2/1990 Woods ..... B65D 31/02 383/104
4,939,030 A 7/1990 Tsuji et al.
4,950,859 A * 8/1990 Anderson ..... B65D 81/3461 219/727
5,474,383 A * 12/1995 Zuege ..... B65D 31/08 219/727
5,709,479 A * 1/1998 Bell ..... B65D 75/008 383/10
5,785,428 A * 7/1998 Mazzocchi ..... B65D 33/01 383/103
5,830,548 A 11/1998 Andersen et al.
5,939,117 A 8/1999 Chen et al.
5,947,884 A 9/1999 Sasaki et al.
6,048,558 A 4/2000 Feldmeier et al.
6,159,512 A 12/2000 Reyes
6,265,038 B1 * 7/2001 Frisk ..... B32B 27/36 222/566
6,303,363 B1 * 10/2001 Ward ..... C12M 23/14 383/104
6,342,258 B1 * 1/2002 Berings ..... B65D 81/3415 206/5
6,376,032 B1 4/2002 Clarke et al.
6,796,712 B1 * 9/2004 Achhammer ..... B65D 75/008 222/527
D501,410 S * 2/2005 Lin ..... D9/707
7,014,363 B2 3/2006 Hanson
7,452,132 B2 * 11/2008 Tang ..... B65D 33/2508 383/100
7,942,578 B2 5/2011 Andersen
8,389,596 B2 3/2013 Boyce et al.
8,414,188 B2 * 4/2013 Koesters ..... B65D 33/10 383/104
8,569,411 B2 10/2013 Tilton
8,684,600 B2 * 4/2014 Sus ..... A47J 27/18 220/9.4
8,827,557 B2 * 9/2014 Wallander ..... B65D 31/02 383/120
2002/0141666 A1 10/2002 Kuge
2002/0186900 A1 12/2002 Horne
2003/0077010 A1 * 4/2003 Schulz ..... B65D 75/008 383/66
2004/0013325 A1 * 1/2004 Cook ..... B65D 31/08 383/104
2004/0151812 A1 8/2004 Bell
2007/0071370 A1 * 3/2007 Schneider ..... B65D 33/08 383/119
2007/0081745 A1 * 4/2007 Tetenborg ..... B65B 61/02 383/207
2008/0081071 A1 4/2008 Sanghvi et al.
2008/0175521 A1 * 7/2008 Morita ..... B65D 31/16 383/120
2008/0220134 A1 * 9/2008 Cohn ..... A47J 36/16 426/395
2009/0196537 A1 * 8/2009 Aikawa ..... B65D 75/5883 383/120
2013/0064481 A1 3/2013 Yamamoto et al.
2013/0142917 A1 6/2013 Sepehr
2013/0195382 A1 * 8/2013 Murray ..... B65D 75/008 383/10

* cited by examiner

WATERMELON POUCH

CROSS-REFERENCES TO RELATED APPLICATIONS

This application claims priority to U.S. provisional application Ser. No. 61/928,178 filed Jan. 16, 2014, the entire contents of which is incorporated herein by reference.

BACKGROUND OF THE INVENTION

This invention relates to the field of fruit and vegetable produce packaging. More specifically, this invention relates to packaging which was developed to keep larger sliced produce, such as sliced watermelon, viable, for consumption after processing, at a high quality level and freshness for consumption, and easy for the consumer to carry home.

The processing of sliced watermelon typically begins on the farm where whole watermelons are grown and harvested. They are then shipped to terminal markets where they are sold and delivered to packing houses where the watermelons are received and processed prior to distribution to markets or grocery stores. Watermelons are then shipped to markets or grocery stores where preparation of pre-sliced fruit takes places. The watermelons are sliced as desired, typically in a grocery store's preparation room, and then packaged for sale. Alternatively, food preparation may take place off-site, e.g., when grocery stores or chain retail stores are unable to provide food preparations. In these situations, the watermelons are sliced off-site, e.g., by food preparation companies, packaged and shipped to the retail destination for sale.

Whether preparation of sliced watermelon occurs on-site or off-site, the goal of keeping the sliced pieces viable for consumption and void of contamination are desired, especially during transport. Prior methods of watermelon packaging generally rely upon plastic cling wrap (e.g., Saran™ wrap) wrapped around the sliced watermelon with rind. For example, U.S. Pat. No. 5,948,493, hereby incorporated by reference, discloses a plastic wrap with a cling layer, which is commonly used to package watermelon slices. However, these methods have shown to have a number of problems in food safety and consumer convenience.

Plastic wrap is generally unreliable and will not cling to the food or itself if there is moisture or food particles present. This is particularly bothersome when wrapping produce that contains high water content. Even when there is no moisture present, the "cling" is often not strong enough to keep the food covered. It also does not have the benefit of being reusable since most consumers have difficulty in reusing plastic wrap more than once, either because it is too messy or will not cling properly after coming into contact with moisture or food. Dispensing plastic wrap off of the roll can also be an inconvenient process, being difficult to dispense or hard to tear without it self-sticking.

Plastic wrap has also been shown to have shortcomings in food safety. Depending on the material that the plastic wrap is made out of, some materials are more permeable than others, allowing air and moisture to pass through. This may decrease the shelf life of the fresh fruit. Watermelon slices that are covered with plastic wrap have also been found to harbor considerably more bacteria than unwrapped watermelon slices. This suggests that plastic wrap may also provide a convenient breeding ground for bacteria.

The present invention seeks to provide an alternative to plastic wrap for consumers of processed watermelon which improves food safety, convenience, and maintains high levels of watermelon quality and freshness.

SUMMARY OF THE INVENTION

The present invention provides a watermelon pouch designed with a gusseted floor to accommodate a large watermelon slice. The pouch provides an upwardly concave interior volume to orient and stabilize a watermelon for best presentation and least damage, and sturdy sidewalls to support the pouch and contained watermelon on a flat surface. The pouch is re-closable by a zip-lock seal and includes a handle for easy carrying. The watermelon pouch includes a transparent window to allow the consumer to view the watermelon slice inside the pouch, and the transparent window is framed by a graphical element to enhance the product's visual appeal.

One embodiment of the present invention provides a watermelon pouch having an enclosure defining a volume for receiving at least a portion of a watermelon therein. The enclosure has a front panel with a top edge, a bottom edge, a first side edge and a second side edge. The enclosure also has a back panel positionable to extend along a plane parallel to the front panel and having a top edge, a bottom edge, a first side edge and a second side edge. The enclosure also has a gusset having a front edge, a back edge, and a first and second side edge. The bottom edge of the front panel is attached to the front edge of the gusset and the bottom edge of the back panel is attached to the back edge of the gusset. An upper portion of the first side edge of the front panel is attached to an upper portion of the first side edge of the back panel and an upper portion of the second side edge of the front panel is attached to an upper portion of the second side edge of the back panel. The top edge of the front panel and the top edge of the back panel provide a separation defining an enclosure opening. At least one of the front panel and back panel includes a transparent window where the window is at least partially framed by a graphic element.

It is thus a feature of at least one embodiment of the invention to provide a pouch for carrying watermelon slice that has a gusseted floor for accommodating the size and particular shape of a watermelon slice. The pouch also has a window for allowing the watermelon contents to be seen and also enhanced by the graphical element.

The present invention provides that a corner of the front panel defined by the first side edge and the bottom edge, and a corner of the gusset defined by the front edge and the first side edge, are bonded along a bonding line traversing the corners; a corner of the front panel defined by the second side edge and the bottom edge, and a corner of the gusset defined by the front edge and the second side edge, are bonded along a bonding line traversing the corners; a corner of the back panel defined by the first side edge and the bottom edge, and a corner of the gusset defined by the back edge and the first side edge, are bonded along a bonding line traversing corners; and a corner of the back panel defined by the second side edge and the bottom edge, and a corner of the gusset defined by the back edge and the second side edge are bonded along a bonding line traversing the corners.

It is thus a feature of at least one embodiment of the invention to bond the corners of the gusseted floor with the sidewalls so that the front and back sidewalls may support the watermelon pouch and prevent the pouch from tipping. The bonded corners also help to create the concave interior of the pouch for supporting the particular shape of the watermelon slices.

The present invention provides that the gusset provides an upwardly concave surface in an interior of the volume for supporting a lower convex surface of a watermelon against portions of the bonding lines.

It is thus a feature of at least one embodiment of the invention for the gusset of the watermelon pouch to cradle the watermelon so that the watermelon slice does not substantially shift during transport.

The present invention provides that a first bond between a lower portion of the first side edge of the front panel and lower portion of the first side edge of the back panel, and a second bond between a lower portion of the second side edge of the front panel and lower portion of the second side edge of the back panel.

It is thus a feature of at least one embodiment of the invention to support the bottom portion of the pouch so that the sidewalls of the pouch remain upright.

The present invention provides that a lower portion of the first side edge of the front panel is attached to a front portion of the first side edge of the gusset along a first seam and a lower portion of the first side edge of the back panel is attached to a back portion of the first side edge of the gusset along a second seam. A lower portion of the second side edge of the front panel is attached to a front portion of the second side edge of the gusset along the third seam and the lower portion of the second side edge of the back panel is attached to a rear portion of the second side edge of the gusset along a fourth seam.

It is thus a feature of at least one embodiment of the invention to attach a lower portion of the sidewalls to the gusset side edges so that the front and back sidewalls and gusset may cooperate to support the lower portion of the watermelon pouch.

The present invention provides that the enclosure opening is selectively sealable by a zip lock seal.

It is thus a feature of at least one embodiment of the invention to provide a reclosable and reusable pouch for the consumer.

The present invention provides that the front panel and the back panel include a handle opening positioned proximate to the top edges.

It is thus a feature of at least one embodiment of the invention to allow the consumer to easily transport the watermelon and the handle to be positioned so that it is not easily ripped or torn.

The present invention provides that the front panel, back panel, and gusset have substantially rectangular peripheries.

It is thus a feature of at least one embodiment of the invention to provide a rectangular bag that is easy to construct using a plastic extrusion process.

The present invention provides that the graphic element is partially transparent.

It is thus a feature of at least one embodiment of the invention to allow the consumer to see a greater portion of the watermelon slice and for the graphic element to correspond with the colors of the watermelon slide to enhance the natural colors of the watermelon slice.

The present invention provides that the volume is sized to receive watermelon slices (slices up to and including a half watermelon slice, e.g., one eighth, quarter, third, or half watermelon slices) providing a hemi-ellipsoidal shape fully contained within the volume.

It is thus a feature of at least one embodiment of the invention to allow the pouch to be the appropriate size to receive a large watermelon slice.

The present invention provides that the graphic element is a simplified watermelon rind.

It is thus a feature of at least one embodiment of the invention to immediately alert the consumer to the contents of the watermelon pouch, and attract the consumer to the product.

The present invention provides that the enclosure is sized and adapted to support a slice of watermelon having a weight of at least 10 or 15 pounds.

It is thus a feature of at least one embodiment of the invention to provide a pouch that will support the weight of a watermelon slice without tearing.

The present invention provides that the enclosure is made of a polymer material that substantially blocks water vapor transmission.

It is thus a feature of at least one embodiment of the invention that the pouch material help maintain the viability of the watermelon.

The present invention provides that the enclosure provides an anti-fog surface.

It is thus a feature of at least one embodiment of the invention to allow the consumer to see the contents of the pouch when fog or moisture builds up in the interior or exterior of the pouch.

The present invention provides that the enclosure is made of an FDA approved food contact material.

It is thus a feature of at least one embodiment of the invention to use materials that are safe to contact with food.

The present invention provides that the enclosure is made of at least one of a polyethylene terephthalate and a low-density polyethylene.

It is thus a feature of at least one embodiment of the invention to construct the pouch out of materials that are sturdy and strong enough to withstand the weight of the watermelon.

One embodiment of the present invention provides a method of selling sliced watermelon in a gusseted watermelon pouch including the steps of constructing a watermelon pouch, as described above, and placing a watermelon slice within the watermelon pouch.

These particular objects and advantages may apply to only some embodiments falling within the claims and thus do not define the scope of the invention.

DETAILED DESCRIPTION OF THE INVENTION

Figure 1:
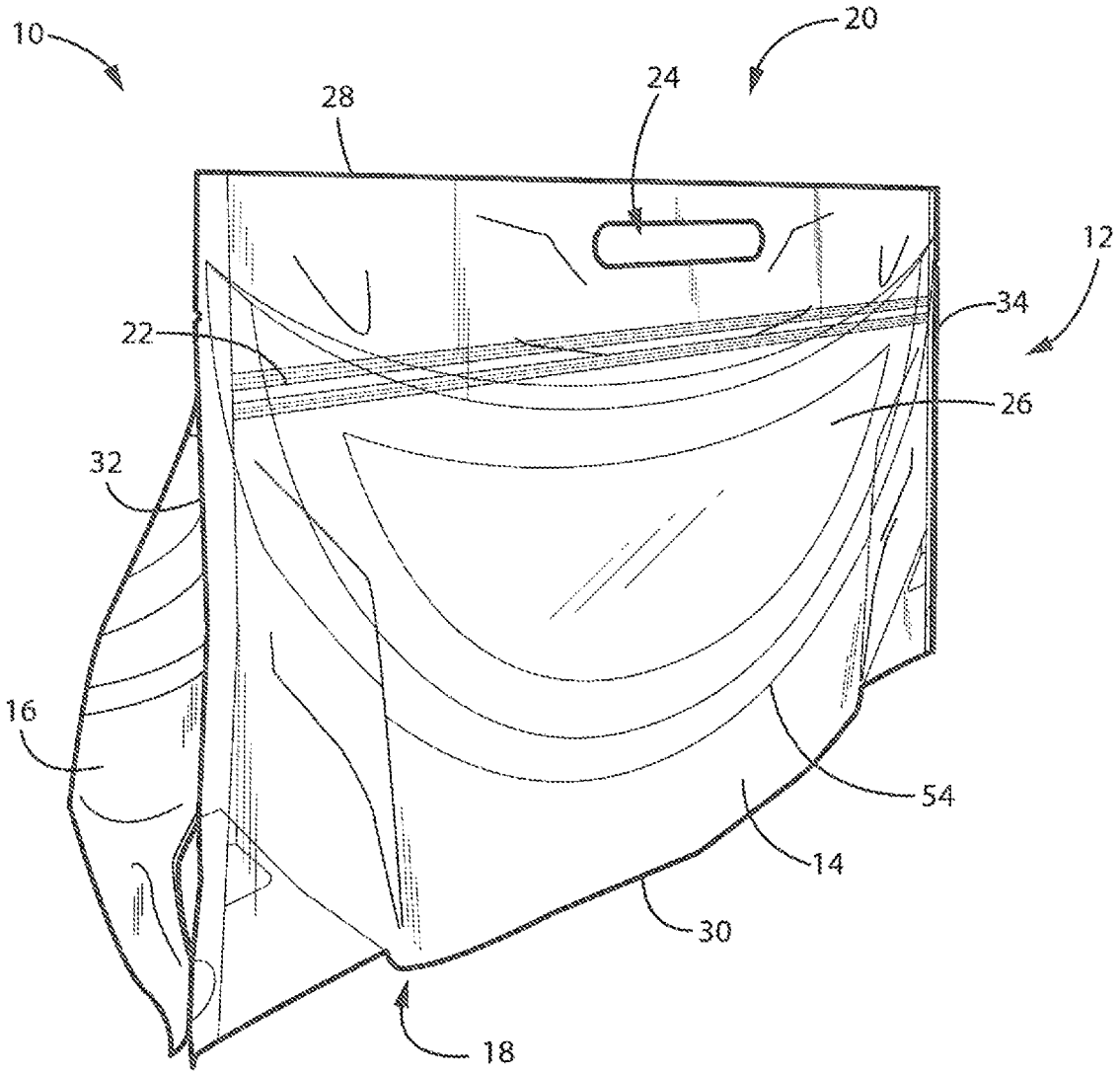
FIG. 1 is a perspective view of a watermelon pouch, of a first embodiment of the present invention, showing the watermelon pouch in an expanded state and having a carrying handle, a zip lock seal, a transparent viewing window framed by a graphic element, and a gusseted floor construction.
Figure 8:
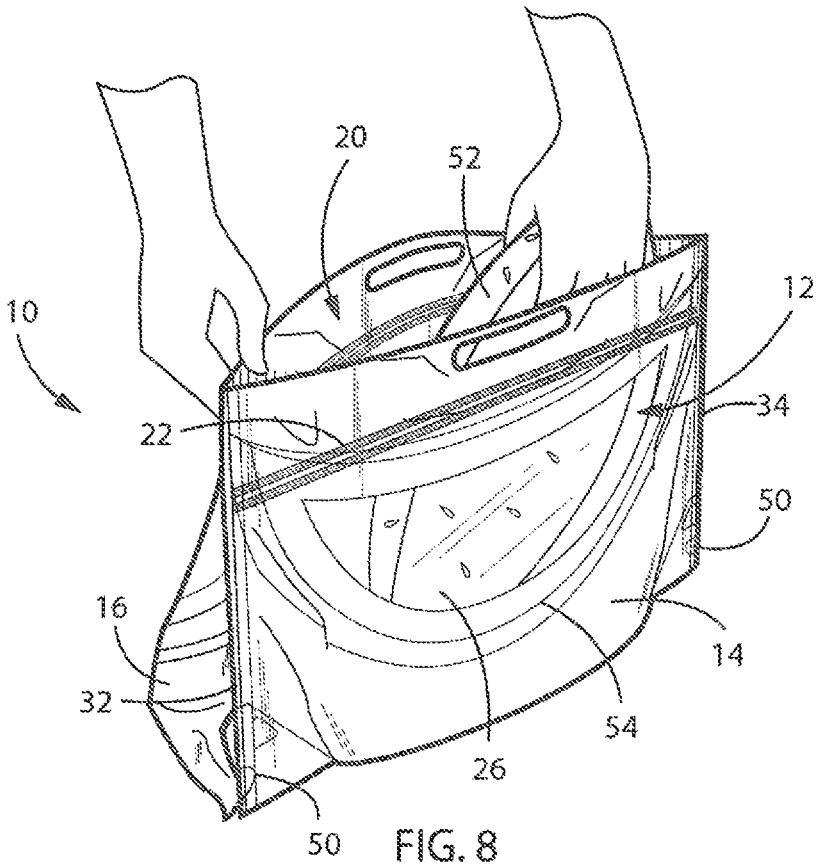
FIG. 8 is a perspective view of a consumer placing a watermelon slice into the watermelon pouch.

Referring to FIGS. 1 and 8, a watermelon pouch 10 according to one embodiment of the present invention may provide a volume 12 for accepting a watermelon piece or watermelon slice 52. The watermelon pouch 10 has a plurality of walls which define the volume 12. A front sidewall 14 is joined on its left 32 and right 34 side edges by a back sidewall 16. The front sidewall 14 and the back sidewall 16 are approximately the same size. The front sidewall 14 and the back sidewall 16 are joined on their bottom sides by a bottom wall 18, defining a gusseted floor of the enclosable volume 12. A single tubular piece of plastic material may be used to form the front sidewall 14, back sidewall 16, and bottom wall 18, or separate pieces may be bonded to join the walls at their respective sides.

The volume 12 may be accessed through the top opening 20 formed by the top edges 28 of the front sidewall 14 and back sidewall 16. An upper portion of the front sidewall 14 and the back sidewall 16 may include a re-closable seal, such as a zip-lock seal 22, which seals the interior of the volume 12 when the zip-lock seal 22 is in the interlocked position. When the zip-lock seal 22 is in the disengaged position, the interior of the pouch or volume 12 is accessible through the top opening 20. The zip-lock seal 22 may be replaced with other types of seals known in the art, such as slider zip-lock seals, slide seals, zipper seals, and flip-top or tuck tops.

The upper portion of the front sidewall 14 and the back sidewall 16 may also include a hole 24, respectively, forming a handle for the consumer to carry the pouch 10. The hole 24 forms a shape that is generally oblong, e.g., an elongated oval or rectangle, and generally sized to allow a consumer's fingers to fit through. The hole 24 is generally positioned in corresponding positions on the front sidewall 14 and the back sidewall 16 so that the hole 24 of the front sidewall 14 and back sidewall 16 are aligned when the top opening 20 of the pouch 10 is closed. The hole 24 may be located centrally between the left 32 and right 34 side edges of the front sidewall 14 and back sidewall 16. The hole 24 may be approximately three-fourths inches to one inch from the top edge to prevent the hole 24 from ripping through to the top edge 28. The hole 24 may be approximately three and one half inches long and one half inches wide to accommodate the consumer's fingers.

A central area of the front sidewall 14 and the back sidewall 16 may include a transparent viewing window 26. For smaller sized pouches 10, the transparent window 26 may be generally centered in the front sidewall 14 and back sidewall 16. For example, the transparent window 26 may be located approximately two inches to three inches from the top edge 28 of the pouch 10 and two inches to three inches from the bottom edge 30 of the pouch 10. Alternatively, for larger sized pouches 10, the transparent window 26 may not be equidistance from the edges and be positioned off-center in the front sidewall 14 and back sidewall 16. For example, the transparent window 26 may be located approximately two inches to three inches from the top edge 28 of the pouch and six inches to seven inches from the bottom edge 30 of the pouch.

The transparent window 26 generally provides a half-circular or crescent shape to resemble a watermelon slice. However, the transparent window 26 may take any desired shape, such as a circular or rectangular shape. The transparent window 26 of the front sidewall 14 and the back sidewall 16 are generally positioned in corresponding positions so that the window 26 of the front sidewall 14 and the back sidewall 16 are aligned when the window 26 is being viewed from a front or back side. The transparent window 26 may have a height of two inches to four inches, at its widest point, depending on the size of the pouch 10. The transparent window 26 may have a length of eleven inches to seventeen inches that generally extends the length of the pouch 10. It is contemplated that the transparent window 26 may only be found at one of the front sidewall 14 and the back sidewall 16 instead of in both sidewalls. The transparent window 26 allows the contents of the pouch 10 to be seen easily so that the consumer can view the watermelon slice and select the desired product based on factors such as ripeness.

It is contemplated that the from sidewall 14 and the back sidewall 16 may contain additional artwork or graphics 54 which may resemble a watermelon slice, such as the rind and part of the watermelon flesh, so that the artwork frames the window 26. In this respect, the consumer is immediately aware of the contents of the pouch 10. The areas of the sidewalls 14, 16 framing the transparent window 26 may be partially transparent to better highlight the colors of the contained watermelon slice 52, and still allowing the watermelon slice 52 to be visible.

The front sidewall 14 and the back sidewall 16 may include product information such as the pouch's contents and other artwork, graphics, or logos to attract the consumer to the product. The bottom wall 18 of the pouch 10 may include required information, such as nutritional facts, recycling information, or a universal product code (UPC) for price scanning. It is contemplated that the information or graphics provided on the bottom wall 18, front sidewall 14, and back sidewall 16 may be interchanged or supplemented as desired.

Figure 2:
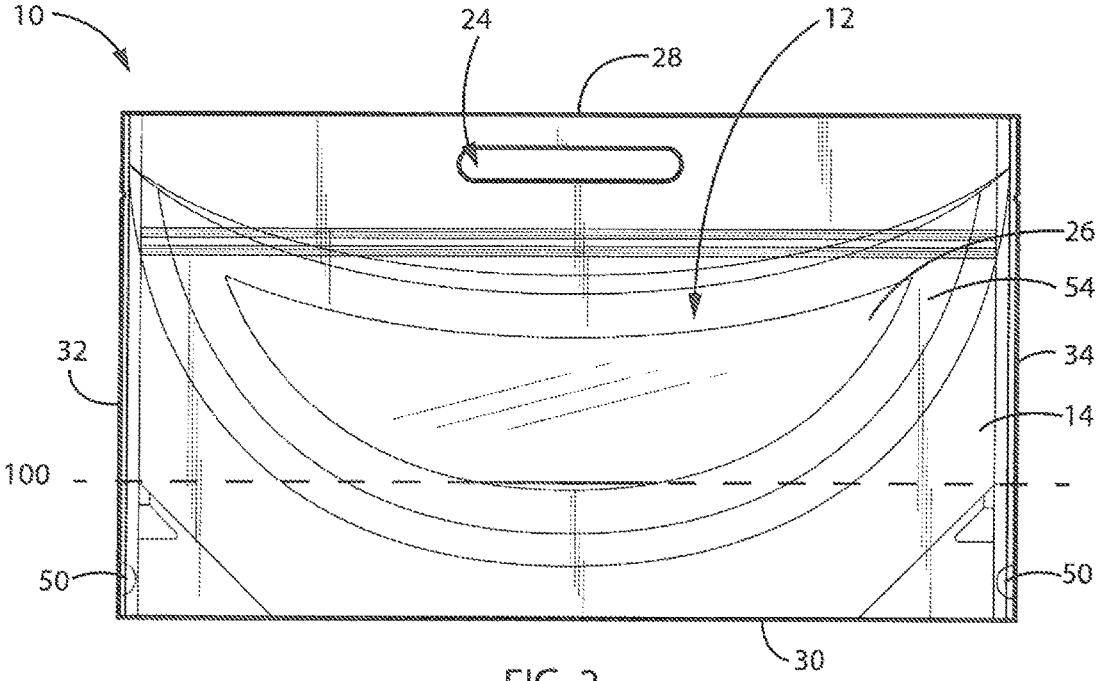
FIG. 2 is a front elevation view of the watermelon pouch of FIG. 1 in a collapsed state.
Figure 3:
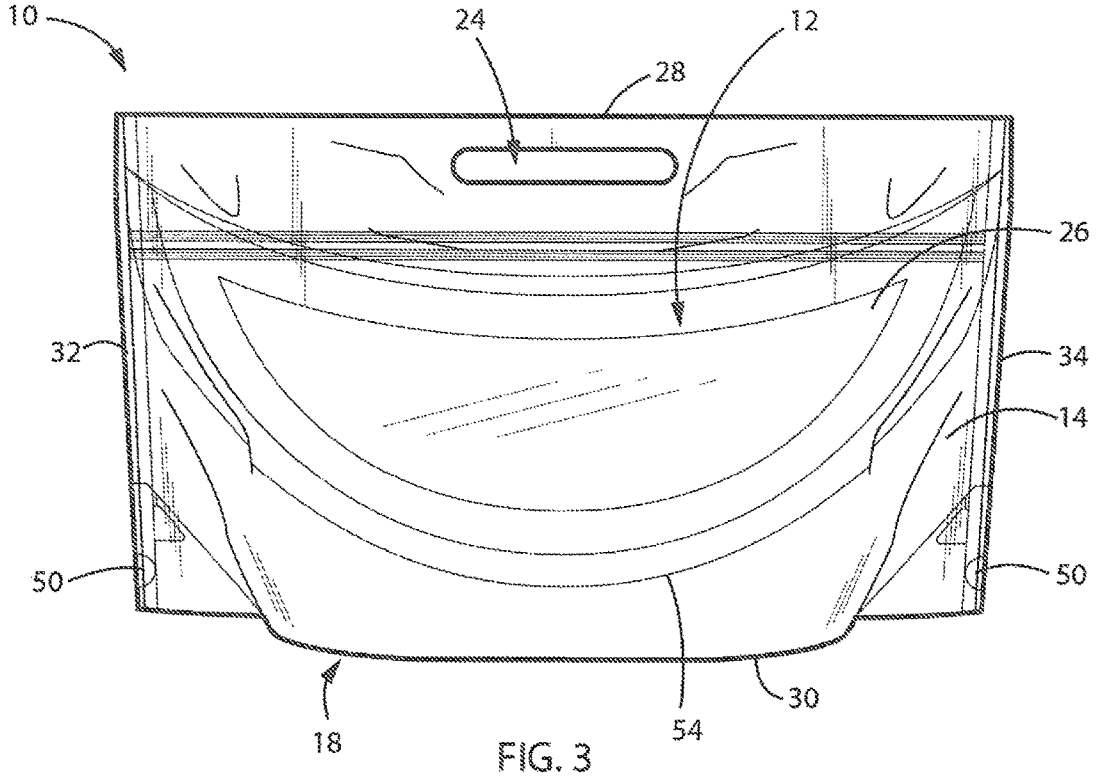
FIG. 3 is a front elevation view of the watermelon pouch of FIG. 1 in the expanded state.
Figure 4:
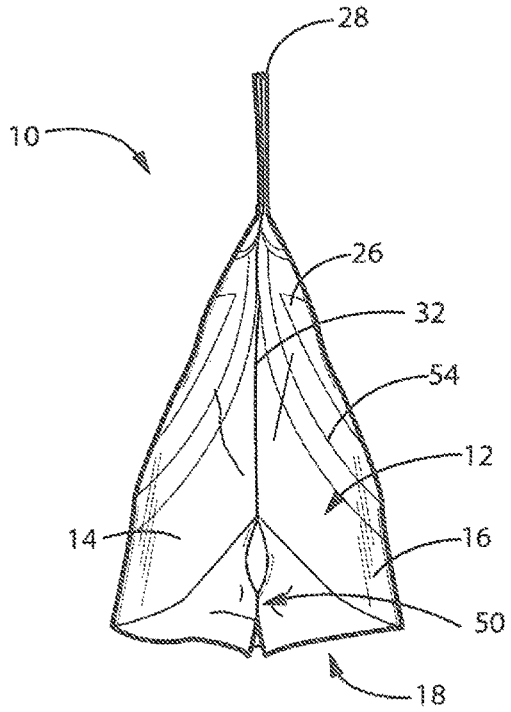
FIG. 4 is a side elevation view of the watermelon pouch of FIG. 1 in the expanded state.
Figure 5:
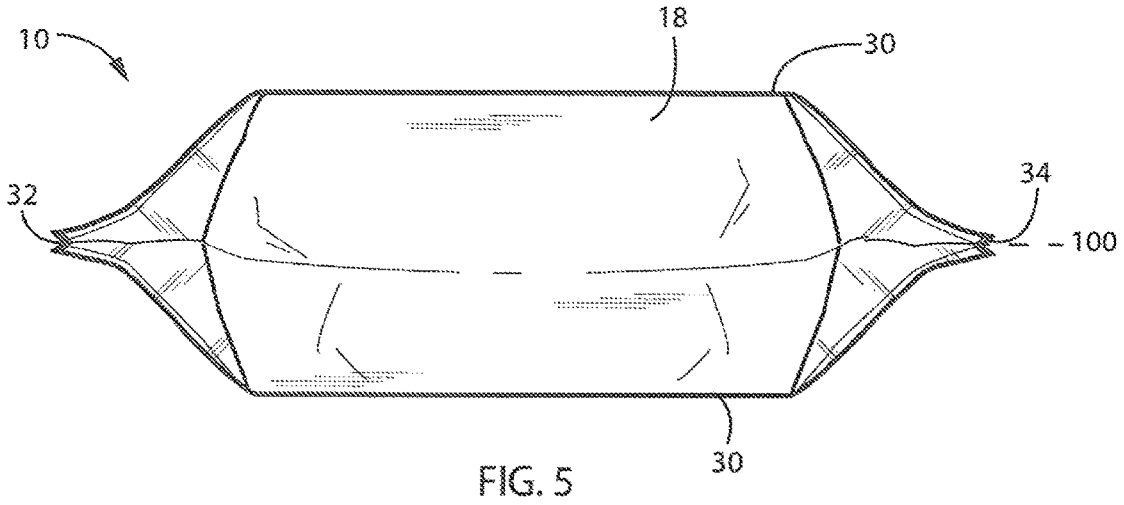
FIG. 5 is a bottom plan view of the watermelon pouch of FIG. 1 in the expanded state.
Figure 6:
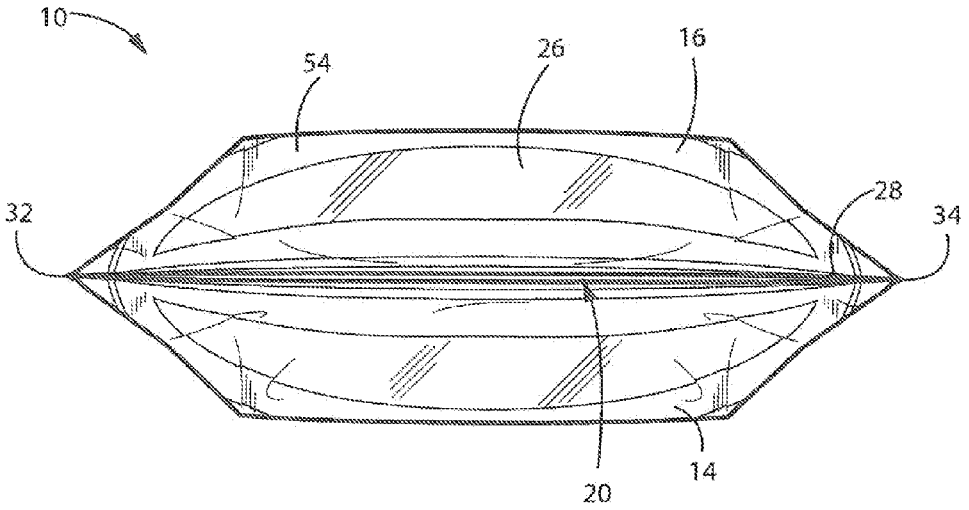
FIG. 6 is a top plan view of the watermelon pouch of FIG. 1 in the expanded state.

As seen in FIG. 2, the pouch 10 may be folded to a collapsed state when the volume 12 of the pouch 10 is empty. In this manner, the front sidewall 14 and back sidewall 16 are visible from a front and back side, but the bottom wall 18 is creased horizontally along a line (100), and folded inward between a bottom portion of the front sidewall 14 and bottom portion of the back sidewall 16. The collapsed state allows the pouch 10 to be stored flat when not in use.

As seen in FIGS. 3-6, the pouch 10 may be unfolded to an expanded state when the pouch 10 is ready to accept contents or is filled with a watermelon slice 52 within the volume 12. In the expanded state, the bottom wall 18 forms a gusseted floor and is substantially unfolded from between the front sidewall 14 and the back sidewall 16 so that the bottom wall 18 is no longer creased along line (100) and is substantially spread out in order to contact the table or supporting surface. The front sidewall 14 and back sidewall 16 remain joined on their left 32 and right 34 side edges so as to support the pouch 10 when in the expanded state, as will be described in further detail below.

As shown in FIGS. 7A-7E, the folds and bonds of the pouch. 10 further illustrate the construction of the watermelon pouch 10 described above. It is contemplated that construction of the pouch 10 may take place by a plastic extrusion process which forms the walls of the pouch 10 using a tubular plastic material. Alternatively, separate plastic pieces may be bound together to form the walls. The graphics 54 are then printed on the pouch 10, such as by a reverse printing process, to provide the transparent window 26 and the artwork framing the window 26. The folds and bonding of the pouch. 10 may be completed, as will be described in further detail below, and the zip-lock seal 22 and hole 24 added by binding and die-cut process, respectively.

A plastic material is provided forming the pouch 10. The plastic material may be one or more layers or combinations of the following plastic materials: polyethylene terephthalate (PET), polyethylene (PE), low-density polyethylene (LDPE), high-density polyethylene (HDPE), linear low density polyethylene (LLDPE), polyvinyl chloride (PVC), polystyrene (PS), and polypropylene (PP). The plastic material is generally a heavy duty material so that the material will not deteriorate easily when exposed to water or food, and is not easily ripped, torn or punctured. The material is strong enough to withstand the weight of watermelon slices, and may support at least ten pounds or alternatively at least fifteen pounds of weight.

Certain features of the plastic material help maintain the viability of the contained watermelon slices. A film may be added to the plastic material to increase the performance characteristics of the pouch 10. Some of the performance characteristics of the plastic material and/or film may include a substantially zero water-vapor transmission rate to prevent contaminants to permeate through the pouch 10. The plastic material and/or film may also have a low oxygen transmission rate while maintaining the oxygen level at or above two percent during a thirteen day self-life of the watermelon. Also, the plastic material and/or film may be recyclable. Also, the plastic material and/or film may be anti-fog so that the contents may be easily seen through the transparent window 26. An example anti-fog coating is Food Grade Anti-Fog Coating 2098-39-6 available from Hydromer of New Jersey USA. The food contact surfaces of the pouch 10 are also FDA-approved materials, as provided by The U.S. Food and Drug Administration, www.fda.gov, hereby incorporated by reference. Moreover, the food contact surfaces may also be materials approved by The United States Department of Agriculture (USDA) Food and Safety and Inspection Service, as provided by www.fsis.usda.gov, hereby incorporated by reference, and/or The National Sanitation Foundation, as provided by www.nsf.org, hereby incorporated by reference.

It is contemplated that the hole 24 may be reinforced by additional plastic, to prevent the plastic material from ripping. It is also contemplated that a thicker plastic material may be used at an upper end of the pouch 10 containing the hole 24, while a thinner plastic may be used for the rest of the pouch 10.

Figure 7A:
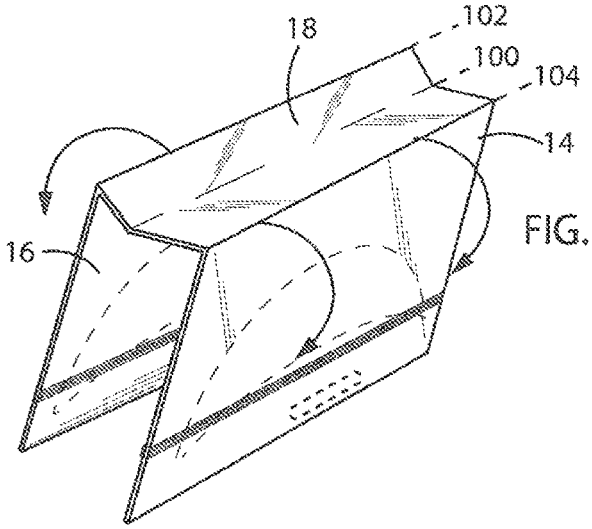
FIG. 7A is a step in the construction of the watermelon pouch showing a rectangular piece of plastic material being folded on first, second and third fold lines.

As seen in FIG. 7*a*, the plastic material forming the pouch 10 is substantially rectangular shaped. A smaller pouch may be fourteen and three-fourths inches (W) by nine and three-fourths inches (H) by six and one-half inches (D), or fifteen inches (W) by nine and three-fourths inches (H) by six inches (D). A larger pouch may be seventeen inches (W) by eleven inches (H) by eight inches (D), or seventeen inches (W) by twelve inches (H) by seven and three-fourths inches (D), or seventeen undies (W) by twelve inches (H) by seven and one-half inches (D). The graphics of the pouch 10 may be smaller than the full dimensions of the pouch 10, such as being between zero and one-half inch smaller than the full width, height or depth of the pouch 10. The smaller pouch may hold quarter slices (or smaller) of watermelon and the larger pouch may hold half slices (or smaller) of watermelon. The pouch 10 is formed by folding and bonding the plastic material along a number of lines and edges. Folds are provided along lines (102) and (104) which form the bottom edges 30 of the front sidewall 14 and back sidewall 16. Another fold along line (100) bisects the bottom wall 18 longitudinally and allows the bottom wall 18 to fold inward during the collapsed state.

Figure 7B:
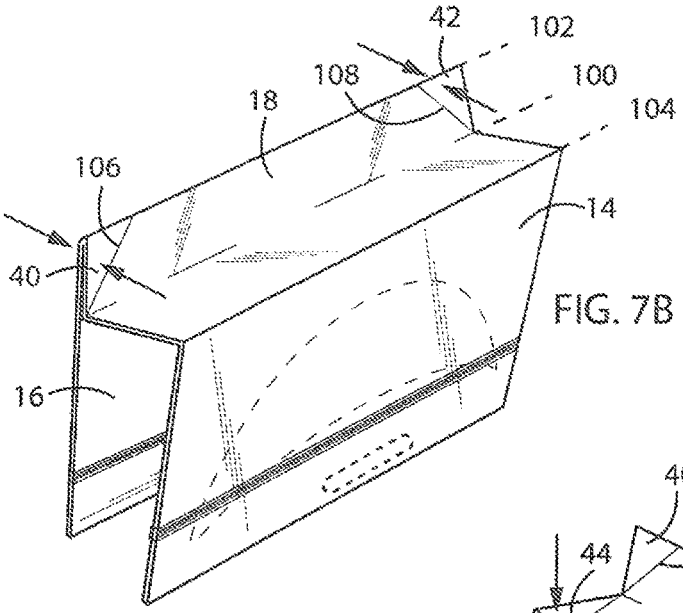
FIG. 7B is a step in the construction of the watermelon pouch showing the plastic being bonded at the corners formed by the first fold.
Figure 7C:
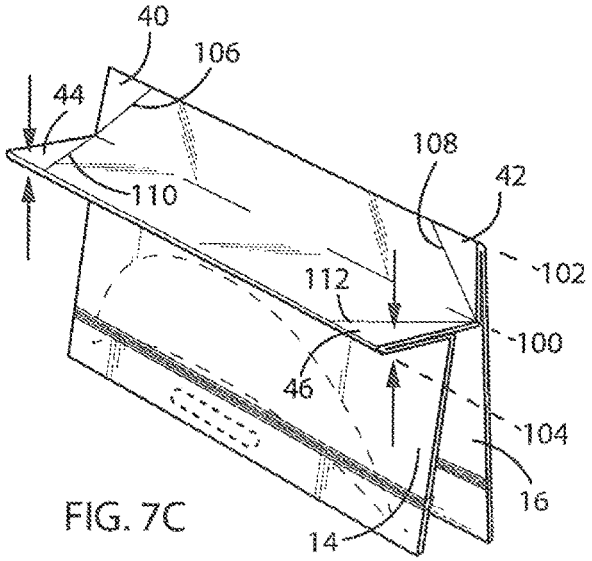
FIG. 7C is a step in the construction of the watermelon pouch showing the plastic being bonded at the corners formed by the second fold.

As seen in FIG. 7*b*, the corners of the back sidewall 16 formed by line (102) are bonded to the respective corners of the bottom wall 18 where the back sidewall 16 meets the bottom wall 18 at a lower right 40 and lower left 42 corners. The corners 40, 42 are bonded along diagonal bonding lines 106, 108 to create triangular segments. The entire interior and periphery of the triangular segments may be adhered together. Alternatively, an air pocket may be left within the interior of the triangular pocket, but adhered along the periphery. As seen in FIG. 7*c*, similar to FIG. 7*b*, the corners of the front sidewall 14 formed by line (104) are bonded to the respective corners of the bottom wall 18 where the front sidewall 14 meets the bottom wall 18 at lower right 44 and lower left 46 corners. The corners are bonded at diagonal bonding lines 110, 112 to create the triangular segments.

Figure 7D:
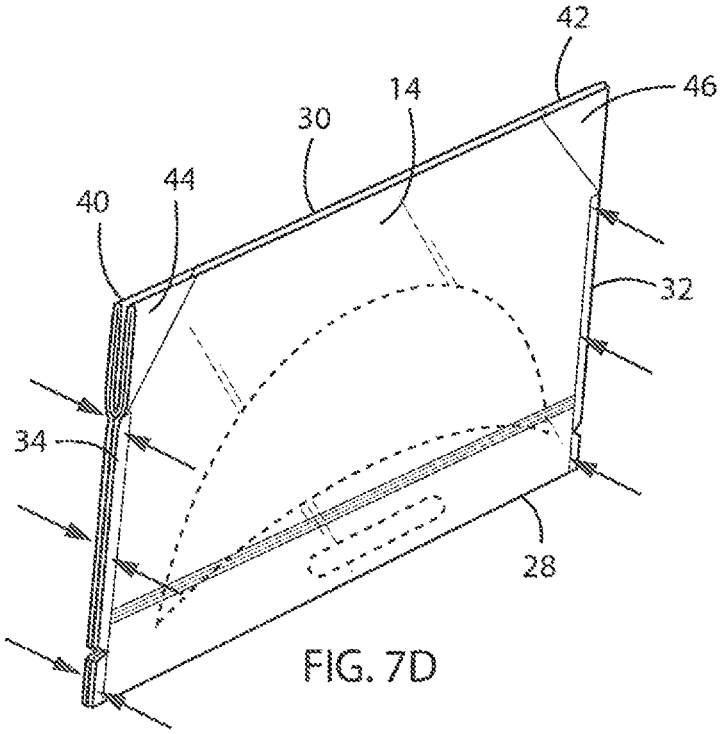
FIG. 7D is a step in the construction of the watermelon pouch showing the plastic being bonded along an upper portion of the left and right sides of the pouch.

As seen in FIG. 7*d*, the front sidewall 14 and back sidewall 16 are then bonded on their left 32 and right 34 side edges so that the bonding runs from the top edge of the left 32 and right 34 side edges of the front sidewall 14 and back sidewall 16 down to the triangular segments 40, 42, 44, 46 formed in FIGS. 7*b* and 7*c*. The bonding attaches the sides of front sidewall 14 to the sides of back sidewall 16 to enclose volume 12.

Figure 7E:
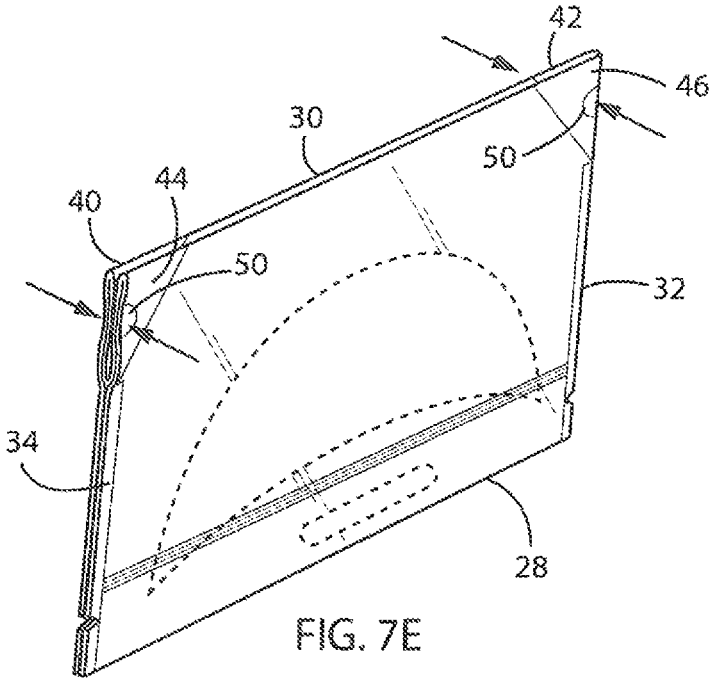
FIG. 7E is a step in the construction of the watermelon pouch showing the lower corners of the pouch being spot welded together.

As seen in FIG. 7*e*, the bottom of the front sidewall 14 and back sidewall 16 are bound or spot welded together at a single weld 50 along the side edges of the triangular segments 40, 42, 44, 46. The weld 50 attaches triangular segment 40 with 44, and 42 with 46. It is contemplated that the bottom side edge of the front sidewall 14 and back sidewall 16 may be spot welded at a single spot, as shown. Alternatively, the bottom edge of the front sidewall 14 and back sidewall 16 may be bound all the way along the side edges 32, 34 of the sidewalls, whereby the bonding of FIG. 7*d* may be made down the entire side edges 32, 34.

Figure 9:
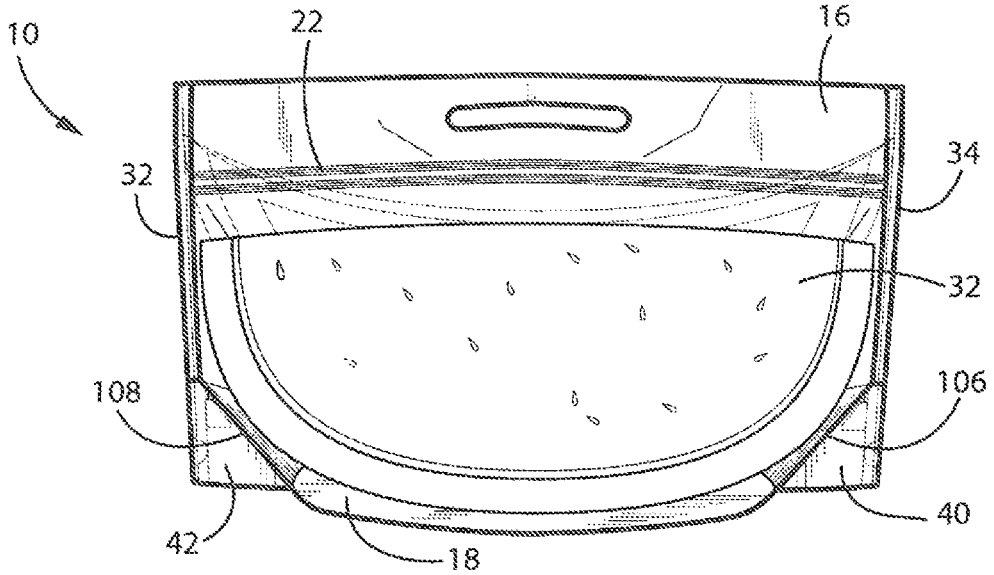
FIG. 9 is a perspective view of a watermelon pouch with a cut-out showing the watermelon slice stabilized within the pouch.

In operation, as seen in FIGS. 8 and 9, the top opening 20 of the watermelon pouch 10 may be opened and the interior volume 12 of the pouch 10 expanded so that the pouch 10 is placed in an expanded state to prepare for receiving a watermelon slice 52. When in an expanded state, the bottom wall 18 is spread to support the size and shape of the watermelon slice 52. The edges of the left side 32 and right side 34, which are spot welded at a bottom end, stabilize the pouch 10 on the table or supporting surface so that the pouch 10 does not tip by the unevenness, shape, or weight of the watermelon slice 52 contained within.

The interior volume 12 contains an upwardly concave surface formed by the bottom wall 18 and diagonal bonding lines 106, 108, 110, 112 for receiving a lower convex surface of the hemi-ellipsoidal watermelon slice 52 therein and against portions of the diagonal bonding lines 106, 108, 110, 112. The volume 12 cradles and centers the watermelon slice 52 so that it is stable and well-supported. The pouch 10 may hold halves, quarters, or eighths slices of a watermelon with rind. The pouch 10 may also hold other sized slices and slices of watermelon without rind. It is contemplated that the watermelon slice 52 would be inserted into the pouch 10 so that the rind is at the bottom of the pouch and the flesh is situated above the rind. However, the watermelon slice 52 may be inserted into the pouch 10 in any orientation. It is contemplated that the watermelon slice 52 may shift during transport.

When the product is placed on display for retail, the transparent window 26 allows the consumer to see the flesh of the watermelon slice 52 and determine if the watermelon slice 52 is ripe by its color and appearance. The rind is generally positioned outside of the transparent window 26 so that it cannot be seen. The opaque areas of the pouch 10 hide any imperfections existent in the rind, and also any watermelon juice which has accumulated at the bottom of the pouch 10. The transparent window 26 is framed by graphics 54 which are colored to correspond with the real watermelon slice 52 inside. The graphics 54 may be partially transparent to highlight the colors of the watermelon slice 52 inside. This visual representation allows the consumer to get an immediate sense of the contents. It also provides uniformity and visual appeal to the product.

When the consumer removes the watermelon slice 52 from the pouch 10, he or she may cut off or consume the desired amount. Then the remaining amount of watermelon slice 52 may be reinserted into the watermelon pouch 10 and resealed by zip-lock seal 22 for future consumption.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

I claim:

1. A melon pouch for holding a slice of melon having upwardly extending edible flesh cradled below by a convex rind, comprising:

an enclosure defining a volume for receiving at least a portion of a melon therein and having a front panel having a top edge, a straight bottom edge, and a first side edge and a second side edge extending from and forming first and second front panels corners of the straight bottom edge;

a back panel substantially the same size as the front panel and positionable to extend along a plane parallel to the front panel and having a top edge, a straight bottom edge, and a first side edge and a second side edge extending from and forming first and second back panel corners of the straight bottom edge;

a reinforced handle opening extending through the front panel and back panel proximate to the top edges and centered between the first and second side edges of the front and back panels, respectively; and a gusset having a front edge, a back edge, and first and second side edges forming first and second front gusset corners and first and second back gusset corners;

wherein the bottom edge of the front panel is attached to the front edge of the gusset and the bottom edge of the back panel is attached to the back edge of the gusset, wherein an upper portion of the first side edge of the front panel is attached to an upper portion of the first side edge of the back panel defining a first side edge attachment and wherein an upper portion of the second side edge of the front panel is attached to an upper portion of the second side edge of the back panel defining a second side edge attachment, wherein the top edge of the front panel and the top edge of the back panel provide a separation defining an enclosure opening, wherein at least one of the front panel and back panel includes a transparent window wherein the window is at least partially framed by a graphic element, wherein the first front panel corner and the first front gusset corner are bonded along a bonding line traversing the corners to form a first bonded triangle segment; the second front panel corner and the second front gusset corner are bonded along a bonding line traversing the corners to form a second bonded triangle segment; the first back panel corner and the first back gusset corner are bonded along a bonding line traversing corners to form a third bonded triangle segment; and the second back panel corner and the second back gusset corner are bonded along a bonding line traversing the corners to form a fourth bonded triangle segment, wherein the first bonded triangle segment is bonded to the third bonded triangle segment along the first side edge to provide a first corner attachment between the first and third bonded triangles with a space between the first corner attachment and the first side edge attachment and the second bonded triangle is bonded to the fourth bonded triangle segment along the second side edge to provide a second corner attachment between the second and fourth bonded triangles with a space between the second corner attachment and the second side edge attachment, wherein the corners of the front panel and back panel extend downward to contact a substantially horizontal surface, and wherein when the slice of melon is received within the volume such that the rind extends downward and the flesh extends upward, the front panel and rear panel cooperate to extend substantially alongside the flesh to center the slice of watermelon therebetween and the gusset provides a substantially continuous support along the convex rind under a weight of the slice of melon when the bag is supported by the reinforced handle.

2. The apparatus of claim 1 wherein the gusset provides an upwardly concave surface in an interior of the volume for supporting a lower convex surface of a melon against portions of the bonding lines.

3. The apparatus of claim 1 wherein the enclosure opening is selectively sealable by a zip lock seal.

4. The apparatus of claim 1 wherein the gusset has a substantially rectangular periphery.

5. The apparatus of claim 1 wherein the graphic element is partially transparent.

6. The apparatus of claim 1 wherein the volume is sized to receive an eighth, quarter, third or half melon slice providing a hemi-ellipsoidal shape fully contained within the volume.

7. The apparatus of claim 1 wherein the graphic element is a simplified melon rind.

8. The apparatus of claim 1 wherein the enclosure is sized and adapted to support a slice of melon having a weight of at least 10 pounds.

9. The apparatus of claim 1 wherein the enclosure is made of a polymer material that substantially blocks water vapor transmission.

10. The apparatus of claim 1 wherein the enclosure provides an anti-fog surface.

11. The apparatus of claim 1 wherein the enclosure is made of an FDA approved food contact material.

12. The apparatus of claim 1 wherein the enclosure is made of at least one of a polyethylene terephthalate and a low-density polyethylene.

13. A method of packaging a slice of melon having upwardly extending edible flesh cradled below by a convex rind in a gusseted melon pouch comprising the following steps:

constructing a melon pouch comprising:

an enclosure defining a volume for receiving at least a portion of a melon therein and having a front panel having a top edge, a straight bottom edge, and a first side edge and a second side edge extending from and forming first and second front panels corners of the straight bottom edge;

a back panel substantially the same size as the front panel and positionable to extend along a plane parallel to the front panel and having a top edge, a straight bottom edge, and a first side edge and a second side edge extending from and forming first and second back panel corners of the straight bottom edge;

a reinforced handle opening extending through the front panel and back panel proximate to the top edges and centered between the first and second side edges of the front and back panels, respectively; and a gusset having a front edge, a back edge, and first and second side edges forming first and second front gusset corners and first and second back gusset corners;

wherein the bottom edge of the front panel is attached to the front edge of the gusset and the bottom edge of the back panel is attached to the back edge of the gusset, wherein an upper portion of the first side edge of the front panel is attached to an upper portion of the first side edge of the back panel defining a first side edge attachment and wherein an upper portion of the second side edge of the front panel is attached to an upper portion of the second side edge of the back panel defining a second side edge attachment, wherein the top edge of the front panel and the top edge of the back panel provide a separation defining an enclosure opening, wherein at least one of the front panel and back panel includes a transparent window wherein the window is at least partially framed by a graphic element wherein the first front panel corner and the first front gusset corner are bonded along a bonding line traversing the corners to form a first bonded triangle segment; the second front panel corner and the second front gusset corner are bonded along a bonding line traversing the corners to form a second bonded triangle segment; the first back panel corner and the first back gusset corner are bonded along a bonding line traversing corners to form a third bonded triangle segment; and the second back panel corner and the second back gusset corner are bonded along a bonding line traversing the corners to form a fourth bonded triangle segment, wherein the first bonded triangle segment is bonded to the third bonded triangle segment along the first side edge to provide a first corner attachment between the first and third bonded triangles with a space between the first corner attachment and the first side edge attachment and the second bonded triangle is bonded to the fourth bonded triangle segment along the second side edge to provide a second corner attachment between the second and fourth bonded triangles with a space between the second corner attachment and the second side edge attachment, wherein the corners of the front panel and back panel extend downward to contact a substantially horizontal surface; and wherein when the slice of melon is received within the volume such that the rind extends downward and the flesh extends upward, the front panel and rear panel cooperate to extend substantially alongside the flesh to center the slice of watermelon therebetween and the gusset provides a substantially continuous support along the convex rind under a weight of the slice of melon when the bag is supported by the reinforced handle; and placing a melon slice within the melon pouch.

14. The method of claim 13 wherein the gusset provides an upwardly concave surface in an interior of the volume for supporting a low convex surface of a melon against portions of the bonding lines.

15. A melon pouch for holding a slice of melon having upwardly extending edible flesh cradled below by a convex rind, comprising:

an enclosure defining a volume for receiving at least a portion of a melon therein and having a front panel having a top edge, a straight bottom edge, and a first side edge and a second side edge extending from and forming first and second front panels corners of the straight bottom edge;

a back panel substantially the same size as the front panel and positionable to extend along a plane parallel to the front panel and having a top edge, a straight bottom edge, and a first side edge and a second side edge extending from and forming first and second back panel corners of the straight bottom edge; and a gusset having a front edge, a back edge, and first and second side edges forming first and second front gusset corners and first and second back gusset corners;

wherein the bottom edge of the front panel is attached to the front edge of the gusset and the bottom edge of the back panel is attached to the back edge of the gusset, wherein an upper portion of the first side edge of the front panel is attached to an upper portion of the first side edge of the back panel defining a first side edge attachment with a first lower end and wherein an upper portion of the second side edge of the front panel is attached to an upper portion of the second side edge of the back panel defining a second side edge attachment with a second lower end, wherein the top edge of the front panel and the top edge of the back panel provide a separation defining an enclosure opening, wherein the first front panel corner and the first front gusset corner are bonded along a bonding line traversing the corners to form a first bonded triangle segment; the second front panel corner and the second front gusset corner are bonded along a bonding line traversing the corners to form a second bonded triangle segment; the first back panel corner and the first back gusset corner are bonded along a bonding line traversing corners to form a third bonded triangle segment; and the second back panel corner and the second back gusset corner are bonded along a bonding line traversing the corners to form a fourth bonded triangle segment, and wherein the first bonded triangle segment is bonded to the third bonded triangle segment along the first side edge and the second bonded triangle is bonded to the fourth bonded triangle segment along the second side edge wherein the first bonded triangle segment is bonded to the third bonded triangle segment at a first corner attachment with a first space arranged between the first lower end of the first side edge attachment and the first corner attachment that defines a first gap between the respective bondings of the first side edge attachment and the first corner attachment, and wherein the second bonded triangle segment is bonded to the fourth bonded triangle segment at a second corner attachment with a second space arranged between the second lower end of the second side edge attachment and the second corner attachment that defines a second gap between the respective bondings of the second side edge attachment and the second corner attachment.

16. A melon pouch for holding a slice of melon having upwardly extending edible flesh cradled below by a convex rind, the melon pouch comprising:

front and back panels connected to each other at outer side edges and a floor that connects bottom portions of the front and back panels to each other and includes a gusset configured to fold inwardly when the melon pouch is not storing a melon to provide a relatively narrower floor and extend outwardly when the melon pouch is storing a melon to provide a relatively wider floor, a lower left corner including, a front left corner segment defined by a generally triangular area of bonding between a left portion of the front panel and a corresponding front portion of the gusset;

a back left corner segment defined by a generally triangular area of bonding between a left portion of the back panel and a corresponding back portion of the gusset;

a lower right corner including, a front right corner segment defined by a generally triangular area of bonding between a right portion of the front panel and a corresponding front portion of the gusset;

a back right corner segment defined by a generally triangular area of bonding between a right portion of the back panel and a corresponding back portion of the gusset;

a left attachment that attaches the front left corner segment and the back left corner segment to each other; and a right attachment that attaches the front right corner segment and the back right corner segment to each other wherein the left attachment is at a location that is spaced from upper and lower ends of the front left corner segment and the back left corner segment to form non-bonded air gaps therebetween, and wherein the right attachment is at a location that is spaced from upper and lower ends of the front right corner segment and the back right corner segment to form non-bonded air gaps therebetween.

* * * * *